US009074382B2

(12) United States Patent
Cheng

(10) Patent No.: US 9,074,382 B2
(45) Date of Patent: Jul. 7, 2015

(54) MULTI-USER PORTABLE TOILET

(76) Inventor: Kevin Cheng, San Francisco, CA (US)

( * ) Notice: Subject to any disclaimer, the term of this patent is extended or adjusted under 35 U.S.C. 154(b) by 558 days.

(21) Appl. No.: 13/281,176

(22) Filed: Oct. 25, 2011

(65) Prior Publication Data

US 2012/0102635 A1 May 3, 2012

Related U.S. Application Data

(60) Provisional application No. 61/407,805, filed on Oct. 28, 2010.

(51) Int. Cl.
*A47K 11/04* (2006.01)
*E04H 1/12* (2006.01)

(52) U.S. Cl.
CPC ..... *E04H 1/1216* (2013.01)

(58) Field of Classification Search
CPC ..... A47K 11/04
USPC ..... 4/300–442, 476
See application file for complete search history.

(56) References Cited

U.S. PATENT DOCUMENTS

D261,975 S * 11/1981 Sauls ..... D7/332
4,922,557 A * 5/1990 Harding et al. ..... 4/477
5,232,232 A * 8/1993 Kishi ..... 280/43.1
5,647,074 A * 7/1997 White et al. ..... 4/664
5,970,914 A * 10/1999 Steil et al. ..... 119/165
6,402,338 B1 * 6/2002 Mitzel et al. ..... 362/154
6,418,672 B1 * 7/2002 Hampel ..... 52/79.1
D497,210 S * 10/2004 Averett et al. ..... D25/33
6,823,639 B2 * 11/2004 Hampel ..... 52/598
7,135,035 B1 * 11/2006 Dimmick ..... 607/90
8,079,096 B2 * 12/2011 Roberts ..... 4/476
2002/0046422 A1 * 4/2002 Perett ..... 4/524
2003/0024191 A1 * 2/2003 Hampel ..... 52/309.1
2004/0163335 A1 * 8/2004 Hampel ..... 52/143
2007/0283488 A1 * 12/2007 Birdsall ..... 4/622
2008/0210141 A1 * 9/2008 Hampel ..... 108/57.33
2009/0077729 A1 * 3/2009 McLeod ..... 4/300
2009/0100585 A1 * 4/2009 Roberts ..... 4/317
2009/0211002 A1 * 8/2009 Norgaard ..... 4/111.1
2009/0235445 A1 * 9/2009 Goldstein ..... 4/462
2011/0186100 A1 * 8/2011 Bolin ..... 135/121
2011/0289671 A1 * 12/2011 Westrick ..... 4/476
2012/0102635 A1 * 5/2012 Cheng ..... 4/476

* cited by examiner

*Primary Examiner* — Lori Baker
(74) *Attorney, Agent, or Firm* — Ray K. Shahani, Esq.; Leo H. Lai, Esq.

(57) ABSTRACT

An improved portable toilet for simultaneous, private use by two persons, the portable toilet which contains an internal compartment having a commode, a waste containment chamber disposed below the commode for receiving waste, an external shell enclosing the compartment and the waste containment chamber, at least one urinal disposed externally upon the external shell and drainage system connecting the external urinal to the waste containment chamber. The portable toilet of the present invention has a cross-section and footprint in the shape of a pentagon.

1 Claim, 16 Drawing Sheets

MULTI-USER PORTABLE TOILET

RELATED APPLICATIONS

This application is a Nonprovisional patent application related to U.S. Provisional Patent Application Ser. No. 61/407,805 filed Oct. 28, 2010 entitled "MULTI-USER PORTABLE TOILET", which is incorporated herein by reference in its entirety, and claims any and all benefits to which it is entitled therefrom.

FIELD OF THE INVENTION

The present invention relates to an improved multi-user portable toilet, and more particularly, to an outdoor portable toilet with external urinal, and arrangements thereof, to meet public needs more efficiently.

BACKGROUND OF THE INVENTION

Portable toilets are simple enclosures containing a chemical or holding tank-type toilet. They are typically used at construction sites, outdoor sporting events, fairs, markets, and other temporary or infrequent gatherings and events. Most portable toilets have the typical open-front-U-shaped toilet seat with cover with or without an optional internal urinal system. They are often constructed out of light weight molded plastic.

The present invention is part of the next generation of portable restrooms, designed to counter the problems that arise due to massive attendance at popular outdoor events such as concerts, fairs, and festivals. Large music festivals which generate traffic of up to 80,000 people per half day should provide up to 1,190 portable restroom units. This alone amounts to more than 26,000 square feet that the venue is required to set aside for the restroom area or areas. Often, events are unable to meet these quotas due to rental cost or space restraints, which result in long lines and rapidly degenerating hygienic conditions. Moreover, with long lines, impatience often leads to inappropriate behavior, such as users urinating on the nearby structure or landscaping.

Portable urinal units are brought in sometimes to meet overwhelming public demands at outdoor events. However, often these systems compromise the user's privacy. Also, almost all portable urinal units need their own waste tank, which increases difficulty in cleaning.

U.S. Publication No. 20090235445, published Sep. 24, 2009 to Goldstein teaches an addition of an external urinal to a conventional portable toilet. It however fails to address the issue of privacy. Additional portable screens may be introduced to alleviate the associated problems, but add to installation and break down time and costs.

Advantages and Summary of Invention

Through innovative use and placement of an external urinal, the present invention allows two people to use a single unit simultaneously, while maintaining privacy of both users. The present invention is a portable toilet assembly with an internal chamber, an external urinal and a shared waste container located beneath the internal chamber.

The simultaneous use of the present invention by 2 users drastically reduces wait times by redirecting urinal users to the back side areas of the units, an area which is generally un-used on the standard portable toilet. The present invention also has the ability to accommodate more users with fewer units which not only reduces the amount of space needed for restrooms at outdoor events or other events in which sufficient indoor restroom facilities are lacking, but also reduces costs, thus allowing extra budget allowance to be spent elsewhere. With less units required per event, less are manufactured and transported, greatly reducing the carbon footprint of portable restrooms. The present invention's external curvature design, integrated into both its overall form and into its structural support are reminiscent of water and gentle waves when multiple units are place side by side.

The portable toilets of the present invention can be arranged in rows, circular and other configurations to best suit the spatial and/or aesthetic requirements and considerations of the venue. Due to the unique design of the present invention, a singular unit in itself can provide acceptable privacy to users of the external urinal. When multiple units are arranged strategically, they create not only a natural private space for the external urinal users, but each adjacent unit provides additional privacy for all users.

Further details, objects and advantages of the present invention will become apparent through the following descriptions, and will be included and incorporated herein.

For a better understanding of the invention reference is made to the following detailed description of the preferred embodiments thereof which should be taken in conjunction with the prior described drawings.

DETAILED DESCRIPTION OF THE PREFERRED EMBODIMENT

The description that follows is presented to enable one skilled in the art to make and use the present invention, and is provided in the context of a particular application and its requirements. Various modifications to the disclosed embodiments will be apparent to those skilled in the art, and the general principals discussed below may be applied to other embodiments and applications without departing from the scope and spirit of the invention. Therefore, the invention is not intended to be limited to the embodiments disclosed, but the invention is to be given the largest possible scope which is consistent with the principals and features described herein.

Figure 3A:
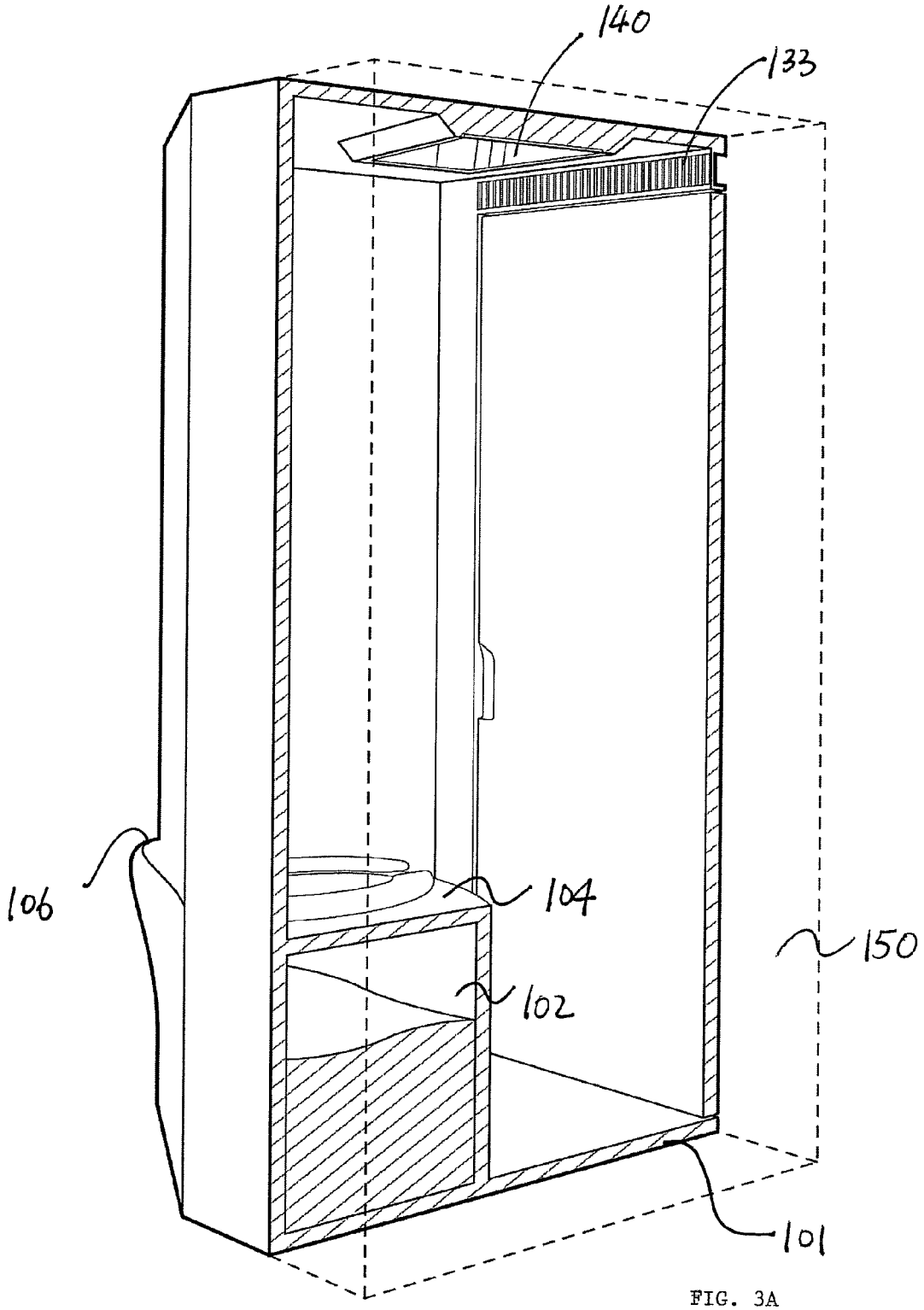
FIG. 3A is a representative cross-sectional view of an embodiment of the multi-user portable toilet 100 of the present invention showing the privacy compartment 150.

FIGS. 1A through 1D are representative isometric views of an embodiment of the multi-user portable toilet 100 of the present invention. In one embodiment, multi-user portable toilet 100 of the present invention is a simple portable enclosure consisting essentially of an internal toilet chamber, i.e., privacy chamber 150, as best shown in FIG. 3A, an external receptacle/urinal 106 and a shared waste containment chamber 102 disposed within the privacy chamber 150. In one embodiment, essential portions of multi-user portable toilet 100 are often constructed out of light weight molded plastic, for easy transportation and cost effectiveness. As best shown in FIGS. 1A to 1D, instead of having four side panels to create a rectangular internal chamber, the multi-user portable toilet of the present invention 100 has five side panels, viz., door panel 130 at the front, right panel 132 and left panel 134, both adjacent to door panel 130, back panel 138, and urinal panel 108 that connects right panel 132, or left panel 134, to back panel 138. All five side panels leave a footprint, and connect to the top panel 136, in the shape of a pentagon.

Figures 1A, 1B:
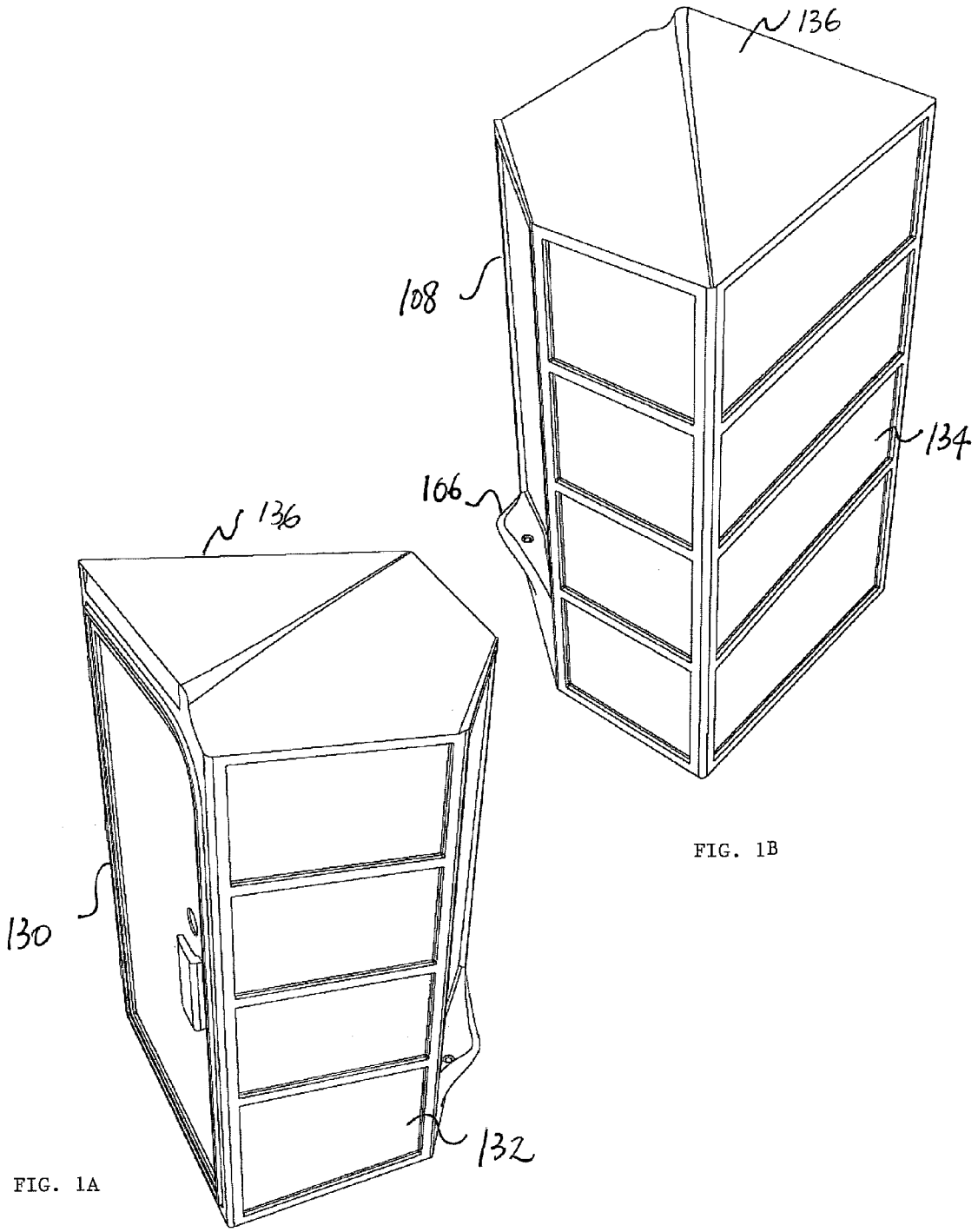
FIGS. 1A through 1D are representative isometric views of an embodiment of the multi-user portable toilet 100 of the present invention.
Figure 1D:
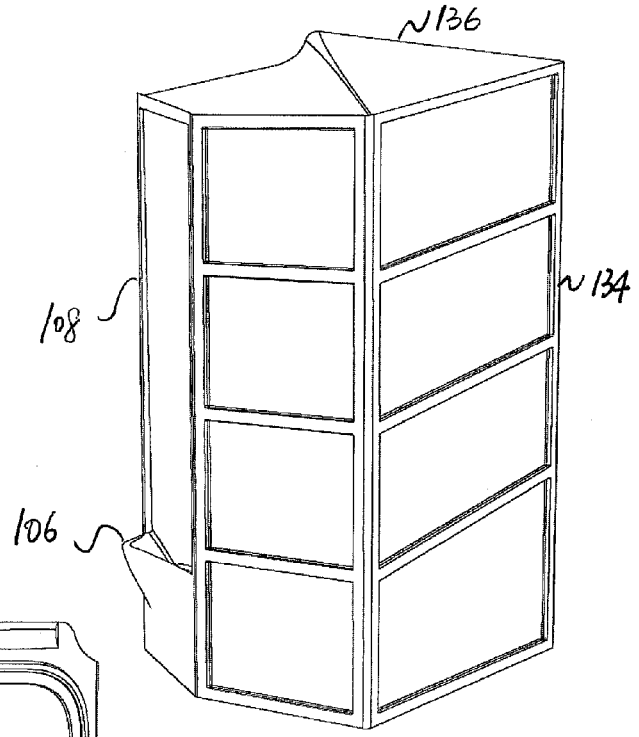
Figure 1C:
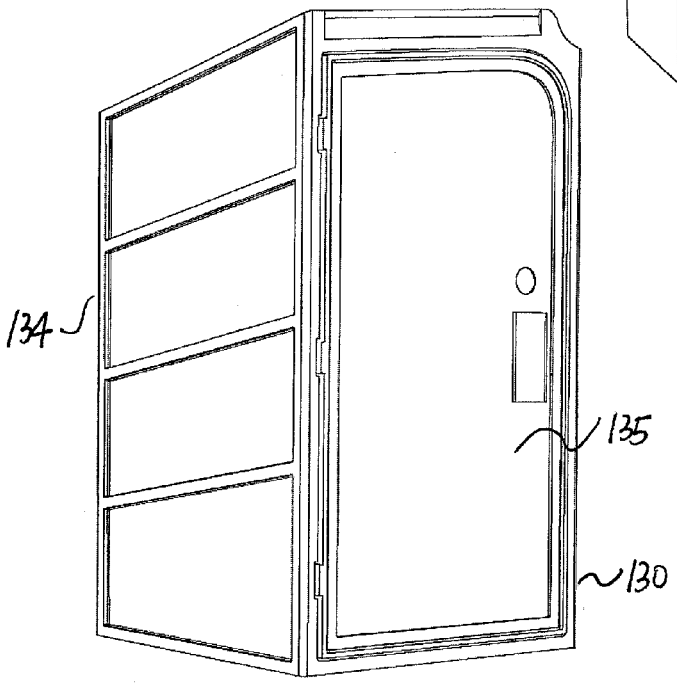
Figure 2E:
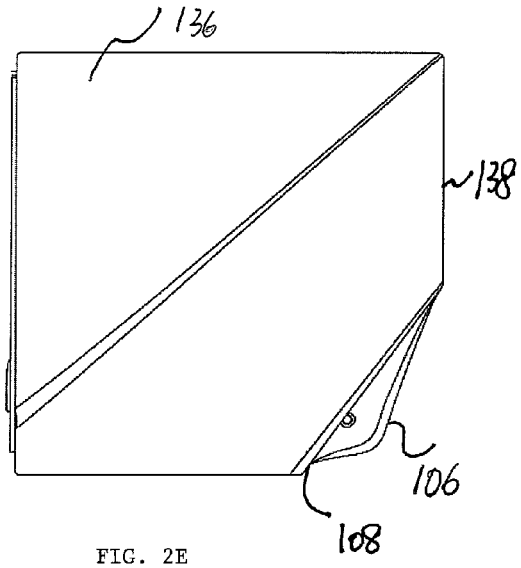
FIG. 2E is a representative top view of an embodiment of the multi-user portable toilet 100 of the present invention.
Figure 2A:
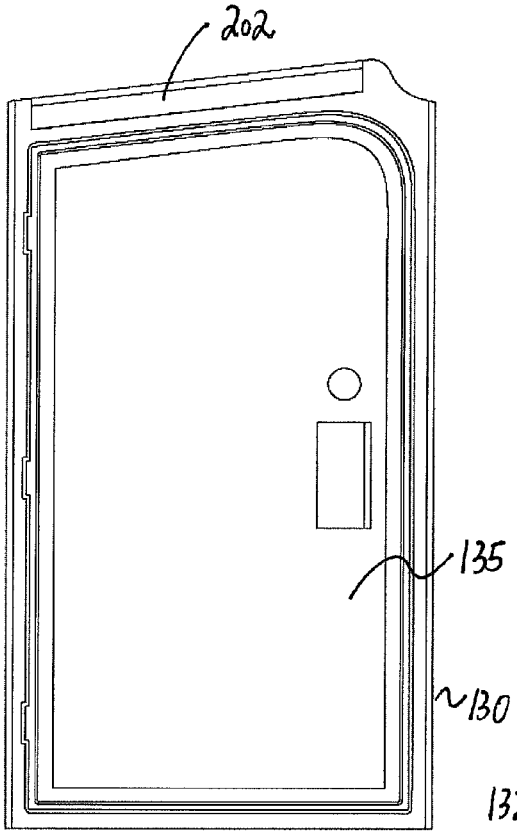
FIGS. 2A through 2D are representative side views of an embodiment of the multi-user portable toilet 100 of the present invention.
Figure 2B:
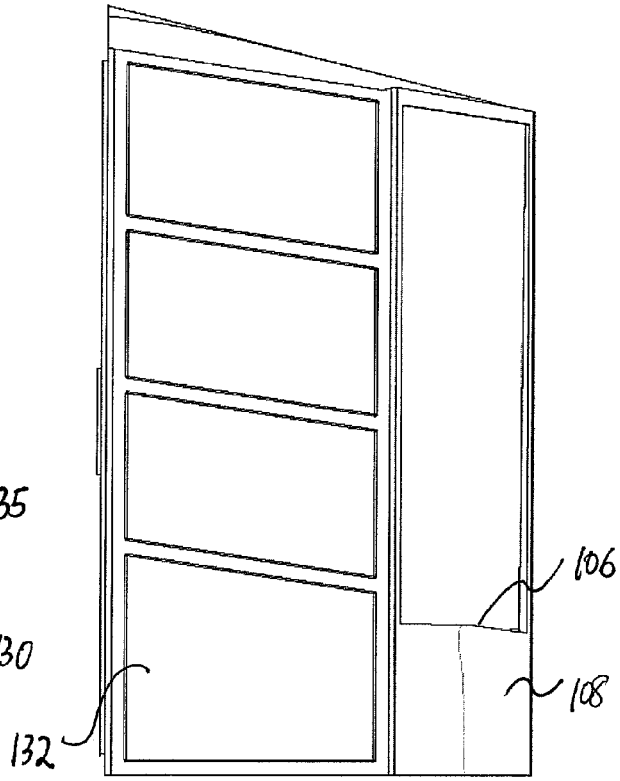
Figure 2D:
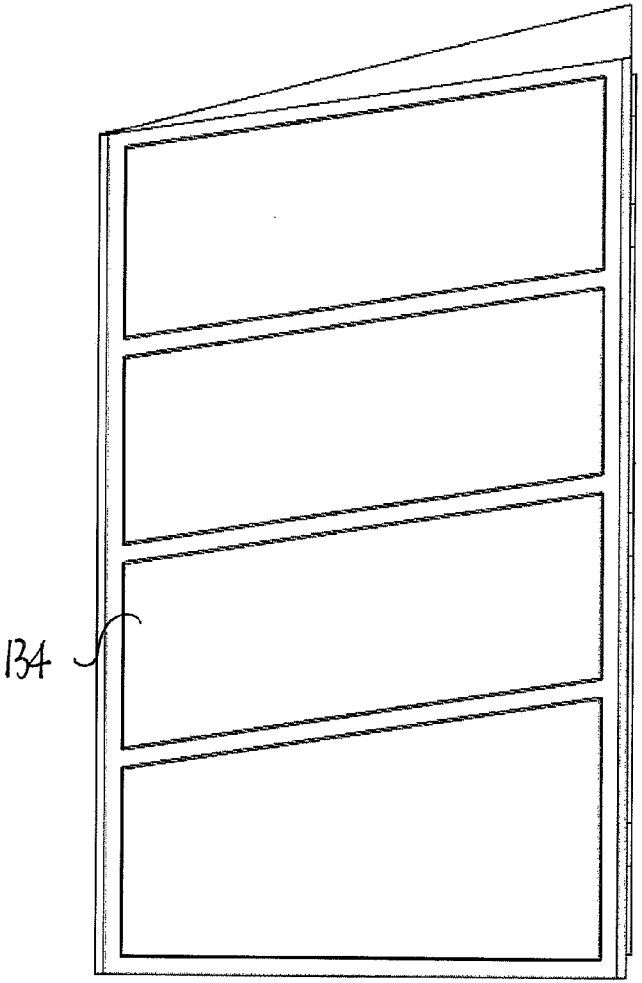
Figure 2C:
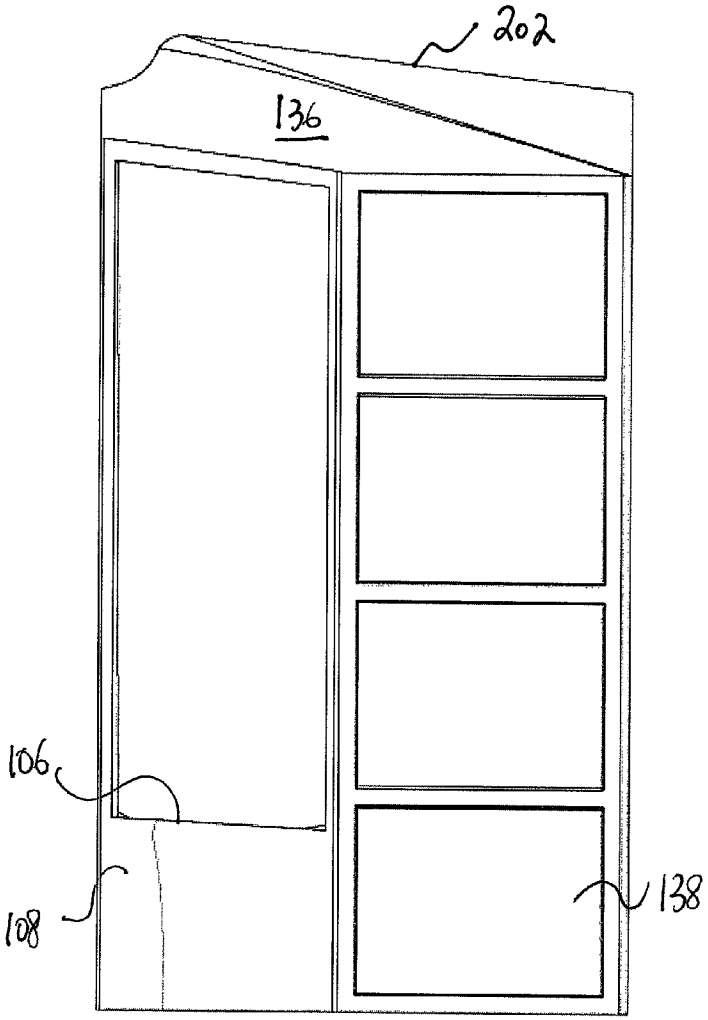

FIGS. 2A through 2D are representative side views of an embodiment of the multi-user portable toilet 100 of the present invention. FIG. 2E is a representative top view of an embodiment of the multi-user portable toilet 100 of the present invention. As best shown in FIGS. 1B and 2E, the top panel 136 is a pentagon resembling a rectangle with one of its corners cut away, that corner replaced with urinal panel 108. As best shown in FIGS. 1C and 2A, a door 135 is installed on door panel 130 so users can enter and exit multi-user portable toilet 100. In one embodiment, a lock or other mechanical closures [not shown] can be installed on door 135 to enhance privacy. A slanting or sloped roof line 202 assists in preventing water pooling on the upper panel 136 during rain, etc.

FIG. 3A is a representative vertical cross-sectional view of an embodiment of the multi-user portable toilet 100 of the present invention showing the privacy compartment 150. In one embodiment, five side panels, viz.; door panel 130 at the front, right panel 132 and left panel 134, back panel 138, and urinal panel 108; and top panel 136, and optionally floor panel 101, create an enclosure i.e. privacy compartment 150. As best shown in FIG. 3A, privacy compartment 150 is an enclosed space which further equipped therein a commode or toilet 104 emptying into a waste containment chamber 102. In one alternative embodiment, water basin which also emptying into waste containment chamber 102, a cold/hot water tap, a soap dispenser could be included within privacy compartment 150. In another embodiment, commode with flushing and plumbing can be introduced to make the present invention 100 more pleasant. In yet another embodiment, lighting fixtures 140 can be installed within privacy compartment 150 for evening events. In yet another embodiment, electric fan, air-conditioning unit 133 and music loudspeakers [not shown] can be installed to further enhance the present invention 100. In one embodiment, speakers [not shown] can also be useful for providing audio instructions for use of the toilet 100, radio performance, emergency news broadcast, etc. optional equipment for the portable toilet 100 include auxiliary plumbing service hookups, hot water service, hot water heater, internal steam or chemical cleaning, holding tank for water, hot water and/or chemical cleaners.

Figure 3C:
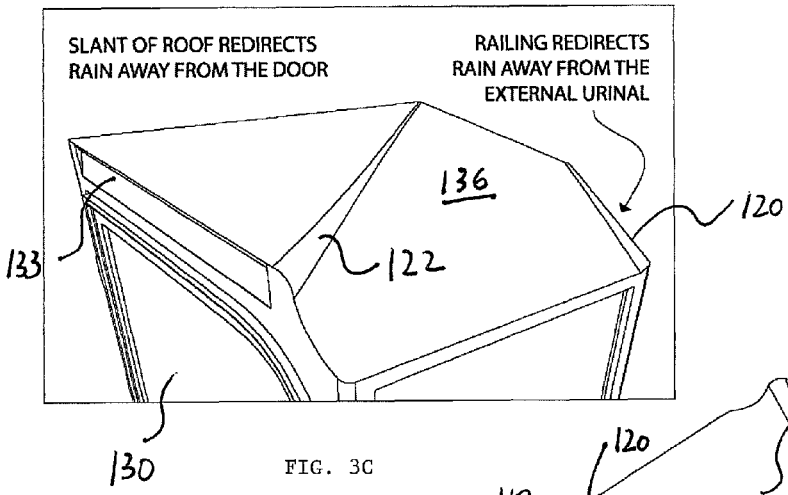
FIG. 3C is a representative top isometric view of an embodiment of the multi-user portable toilet 100 of the present invention showing the contour design of top panel 136.
Figure 3B:
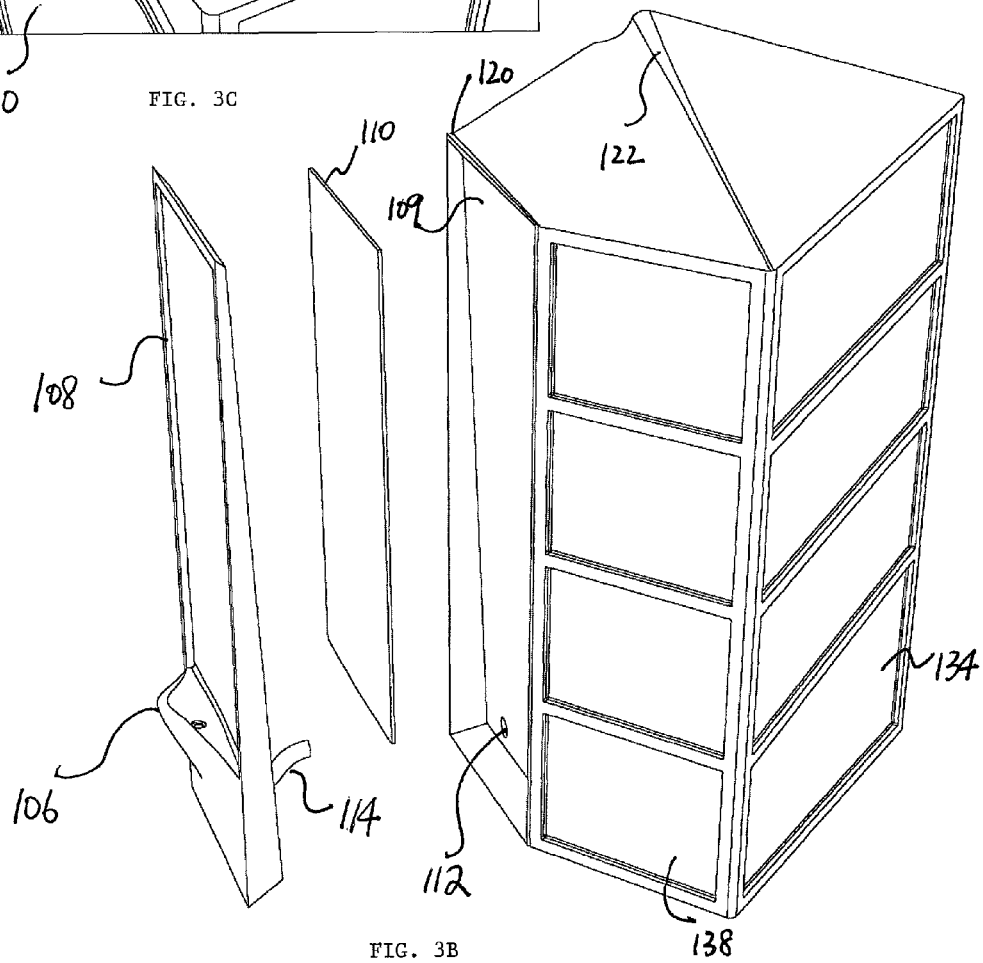
FIG. 3B is a representative isometric view of an embodiment of the multi-user portable toilet 100 of the present invention showing assembly of external urinal panel 108.

FIG. 3B is a representative isometric view of an embodiment of the multi-user portable toilet 100 of the present invention showing assembly of external urinal panel 108. In one embodiment, the external urinal panel 108 further has an urinal 106 installed. The urinal 106 is also equipped with drainage means 114 such that it empties into the shared waste containment chamber 102 within privacy compartment 150 through drainage hole 112. In one embodiment, urinal panel 108 may be recessed, i.e., disposed within a cut-out or alcove in the external wall 109 surrounding the chamber to afford privacy to users. Further, the external wall 109 separating urinal panel 108 from privacy compartment 150 may include sound barrier or sound proofing layer 110 for further privacy between two simultaneous users of toilet 104, i.e., one within privacy compartment 150 and one using external urinal 106. it will be understood that sound proofing layers can also be installed, clad or lined on right panel 132, left panel 134 and/or back panel 138 to provide further privacy to users. In one embodiment, sound proofing layers increase acoustic separation between the inside and outside of privacy compartment 150. Examples of construction material of sound proofing layers or other sound reducing means 110 include QUIET BARRIERS-brand multi-layer soundproofing composite material. This material is an engineered acoustical composite of ½ inch decoupling foam, ⅛ inch high-mass sound-blocking barrier, and ¾ inch noise absorbing foam with 3 mm reinforced mylar facing, as well as other active and passive noise disturbance and cancelling technologies, designed to provide significant air and structure borne noise reduction in a low-profile configuration.

FIG. 3C is a representative top isometric view of an embodiment of the multi-user portable toilet 100 of the present invention showing the contour design of top panel 136. In one embodiment, top panel 136 has vents 133 which are openings that improve air ventilation of privacy compartment 150. In one alternative embodiment, an electric fan [not shown] can be installed around vents 133 to further enhance ventilation. Moreover, one function of top edge panel 120 is to divert falling rain away from door panel 130 and urinal panel 108. External gutters can also be located to divert rain or other water fall to one side or another or to any intermediate, drainage point from the roof and top panel 136 as desired. Downspouts or scuppers can also be installed on the sides or corners of the portable toilet 100 of the present invention to collect and divert rain as desired. Directed drainage is also achieved by the contoured surface of top panel 136 which may have one or more ridges 122 to drain or divert moisture to right panel 132, left panel 134 and/or back panel 138. It is important to divert rain water away from the user. As for the urinal panel 108, since it has urinal 106 that empties into waste containment chamber 102, it is imperative to divert as much rain water away from urinal panel 108 as possible to avoid overflowing waste containment chamber 102. In one embodiment, gutter or railing 120 can be installed at edge of top panel 136 at top of urinal panel 108, acting as a dam to rain water.

Figure 4:
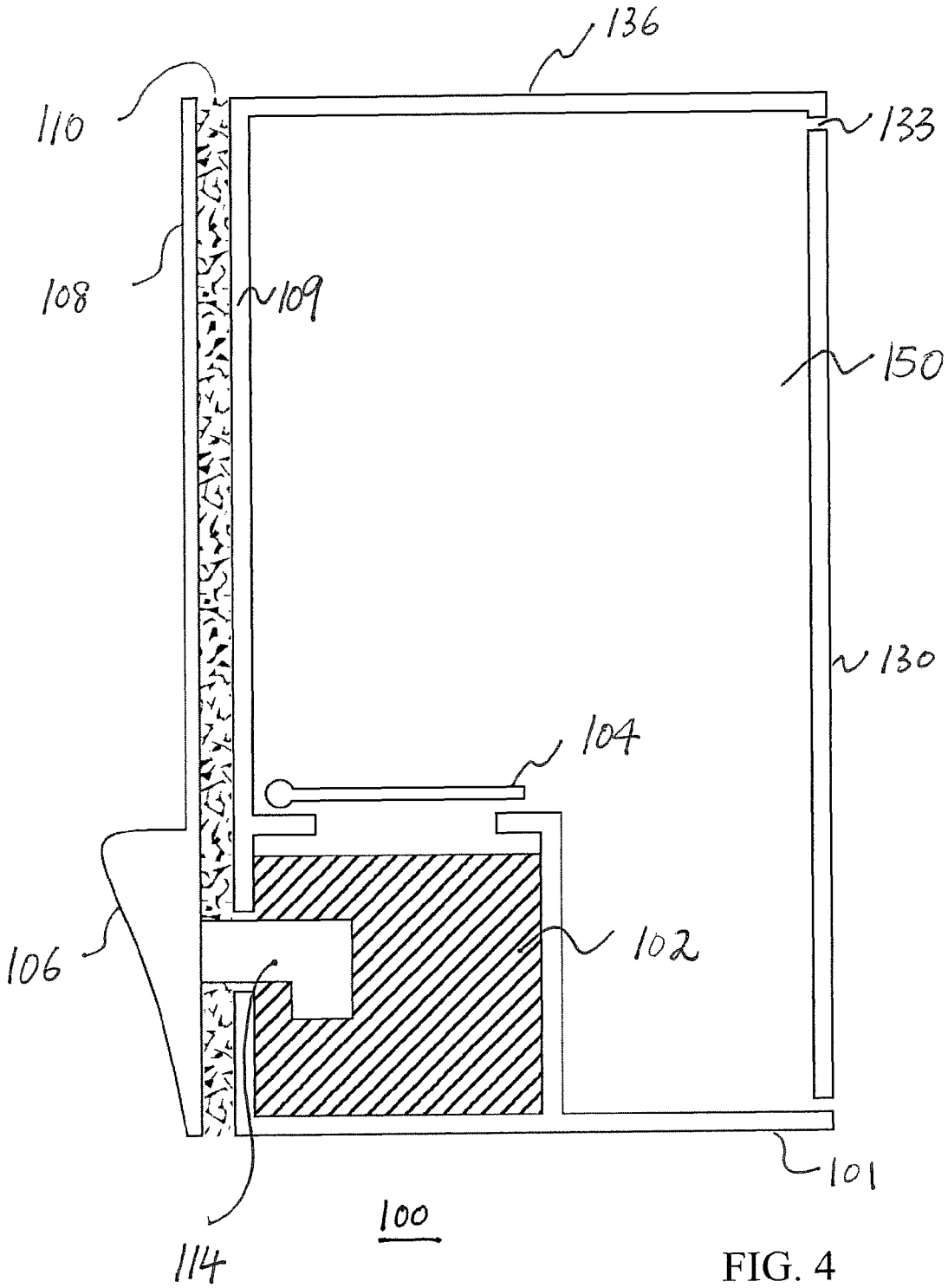
FIG. 4 is a representative lateral, cut-away schematic view showing an embodiment of the portable toilet 100 of the present invention showing the internal commode, waste containment chamber, external urinal, drainage means connecting the external urinal to said waste containment chamber and acoustic insulation/sound-proofing disposed along the compartment shell to provide additional privacy for multiple simultaneous users.

FIG. 4 is a representative lateral, cut-away schematic view showing an embodiment of the portable toilet 100 of the present invention. In this embodiment, two users can multi-user portable toilet 100 simultaneously. The drainage means 114 connecting urinal 106 to waste containment chamber 102 within privacy compartment 150 and sound proofing layers 110 disposed along the side panels to provide additional privacy for simultaneous users.

Figure 5:
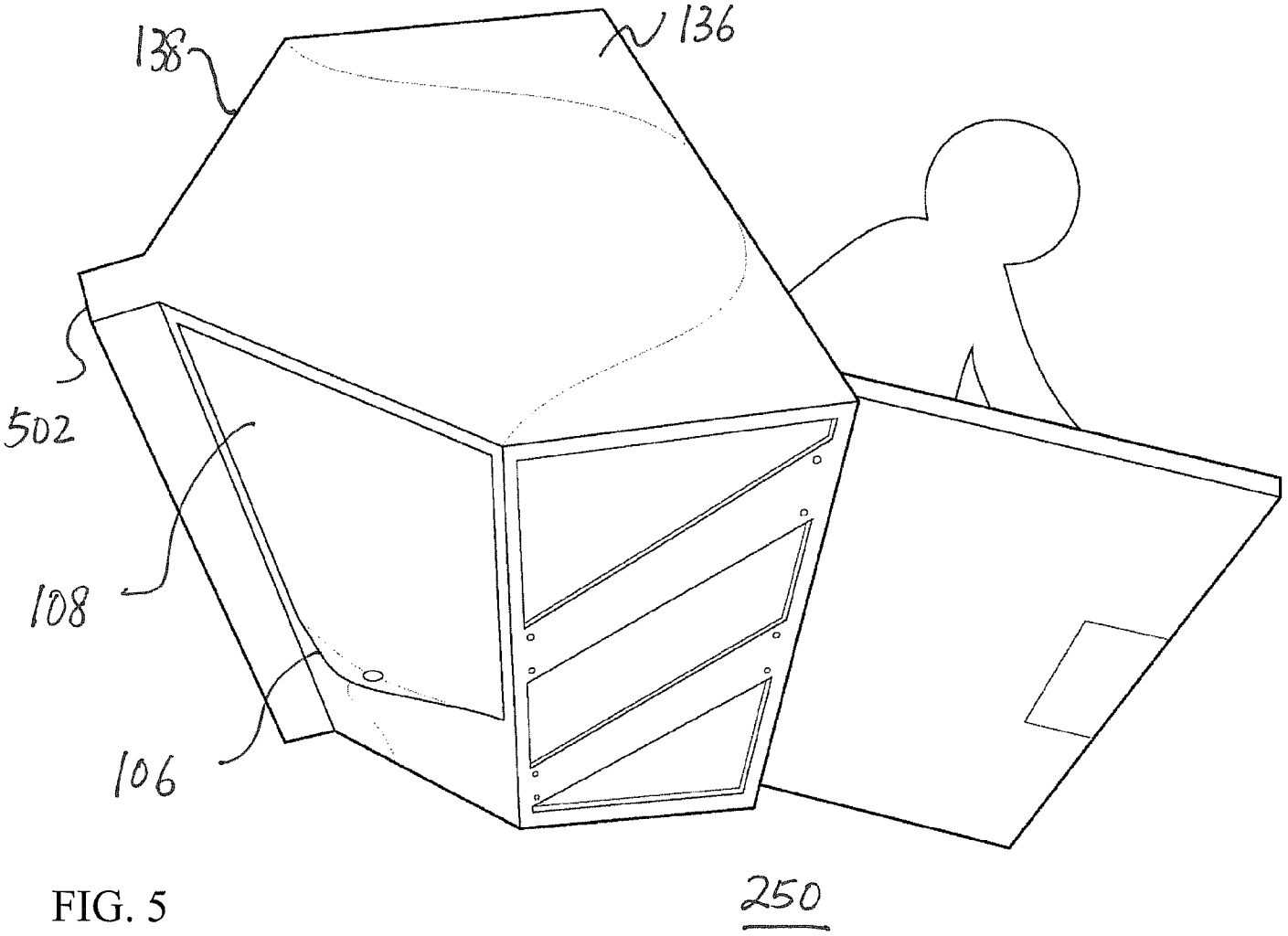
FIG. 5 is a representative isometric view of an alternative embodiment of multi-user portable toilet 600.

FIG. 5 is a representative isometric view of an alternative embodiment of multi-user portable toilet 250 of the present invention where two external urinals 106 and 107 [not shown] are disposed upon the external shell, separated by a privacy protrusion 502. In one alternative embodiments, urinals 106 are installed on both the urinal panel 108 and back panel 138 such that three users can use multi-user portable toilet 600 simultaneously.

Figure 6A:
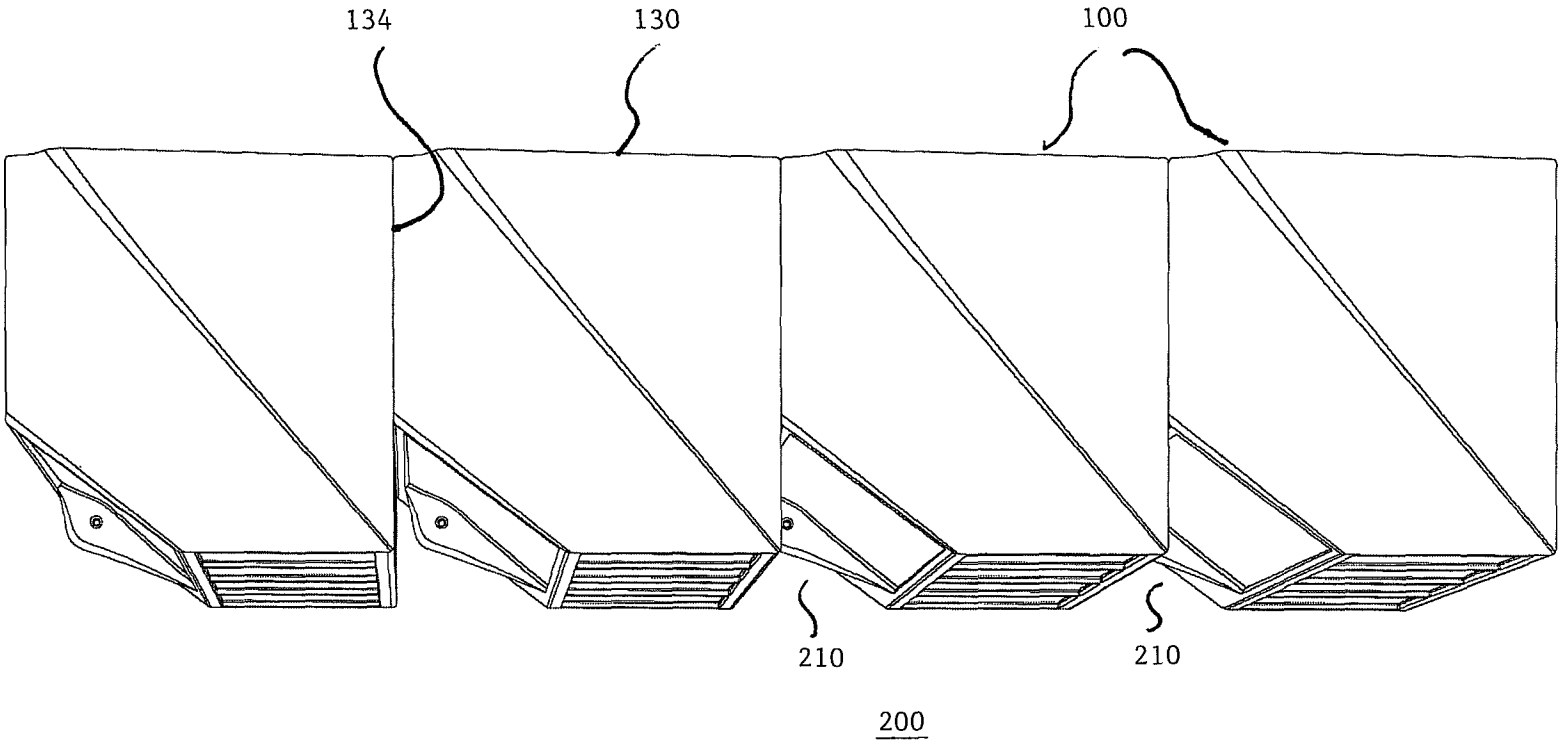
FIG. 6A is a representative top side view of multiple multi-user portable toilets 100 of the present invention in a row arrangement 200.
Figure 6B:
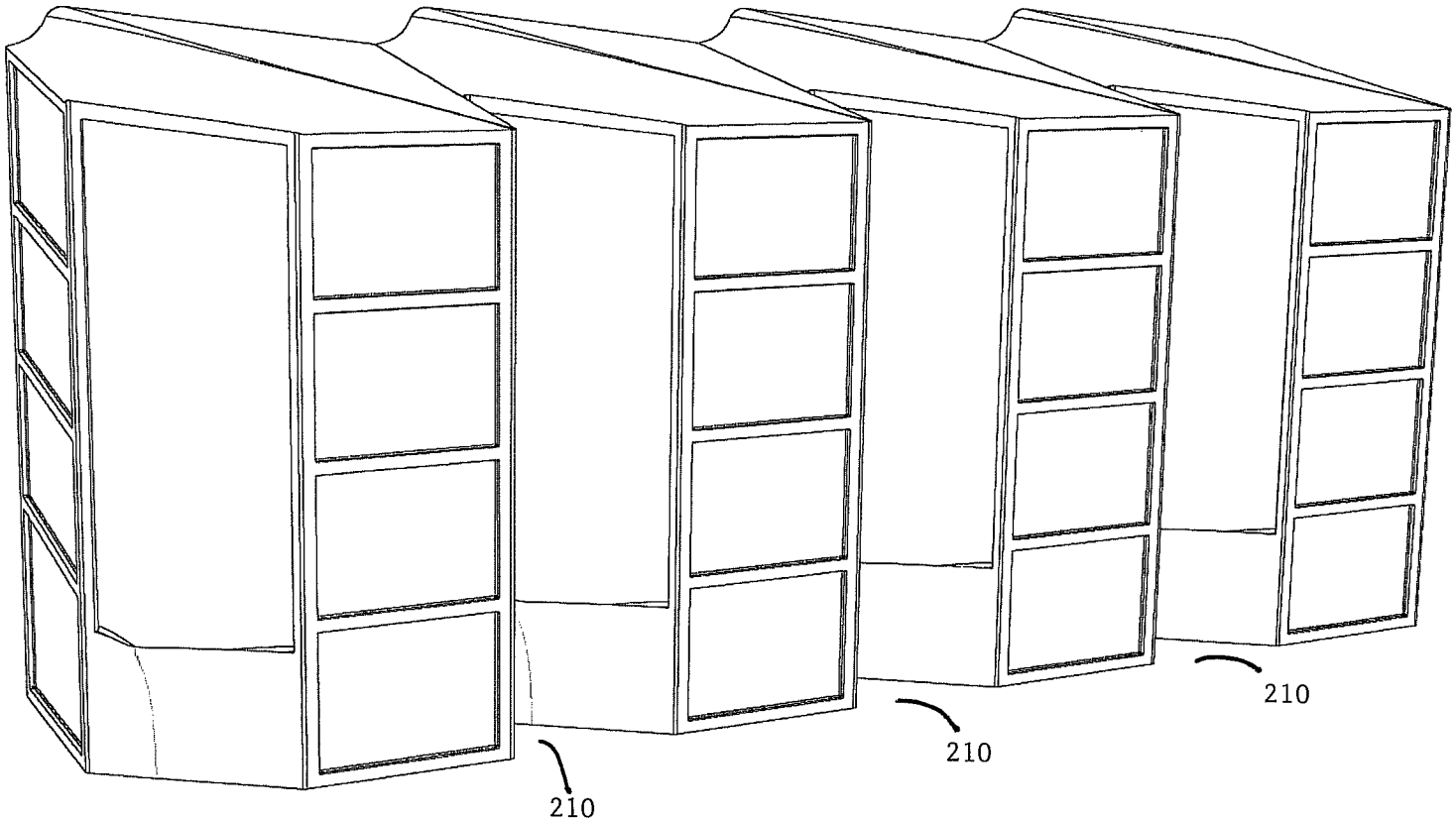
FIG. 6B is a representative back side view of multiple multi-user portable toilets 100 of the present invention in a row arrangement 200.
Figure 6C:
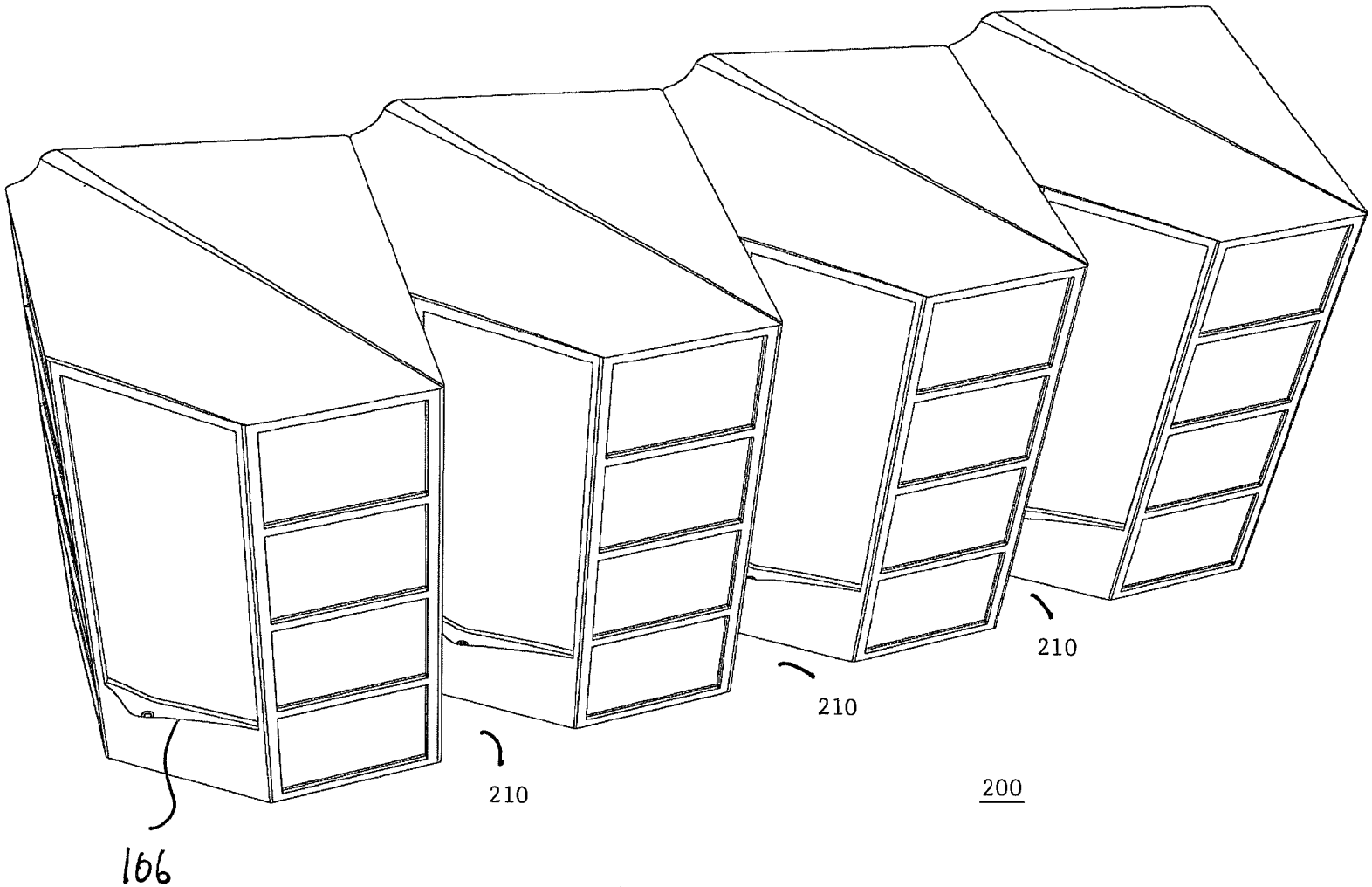
FIG. 6C is a representative upper back side view of multiple multi-user portable toilets 100 of the present invention in a row arrangement 200.

FIG. 6A is a representative top side view of multiple multi-user portable toilets 100 of the present invention in a row arrangement 200. FIG. 6B is a representative back side view of multiple multi-user portable toilets 100 of the present invention in a row arrangement 200. FIG. 6C is a representative upper back side view of multiple multi-user portable toilets 100 of the present invention in a row arrangement 200. FIG. 6D is a representative upper, isometric view showing a method of use of multiple multi-user portable toilets 100 of the present invention in a row arrangement 200. In outdoor events, it is common to arrange multiple portable toilets together to create a temporary lavatory area. When a number of multi-user portable toilets 100 of the present invention are arranged in a row arrangement 200 as best shown in FIGS. 6A to 6D, left panel 134 of each multi-user portable toilet 100 acts as a screen, creating an external urinal area 210 within each multi-user portable toilet 100. The external urinal area 210 provide even more privacy to urinal users.

Figures 7A, 7B, 7C:
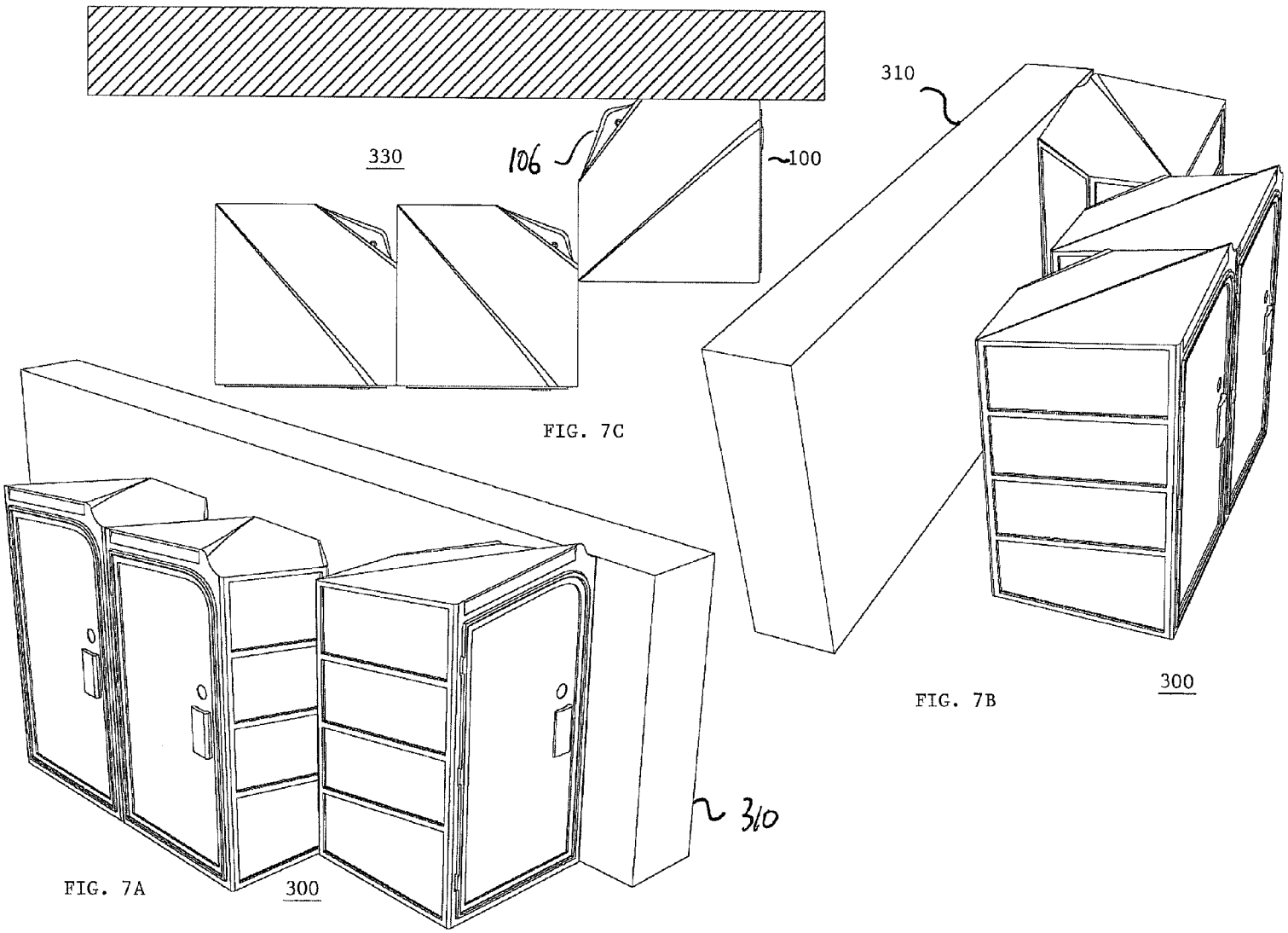
FIGS. 7A through 7C are representative side top isometric and top views, respectively, of multiple multi-user portable toilets 100 of the present invention in a stall arrangement 300.

FIGS. 7A through 7C are representative side, top isometric and top views, respectively, of multiple multi-user portable toilets 100 of the present invention in a stall arrangement 300. In events held in places where outside walls 310 are available, multiple multi-user portable toilets 100 can be arranged in stall arrangement 300 as best shown in FIGS. 7A to 7C, creating a temporary stall 330 for the users of the external urinals 106.

Figure 8A:
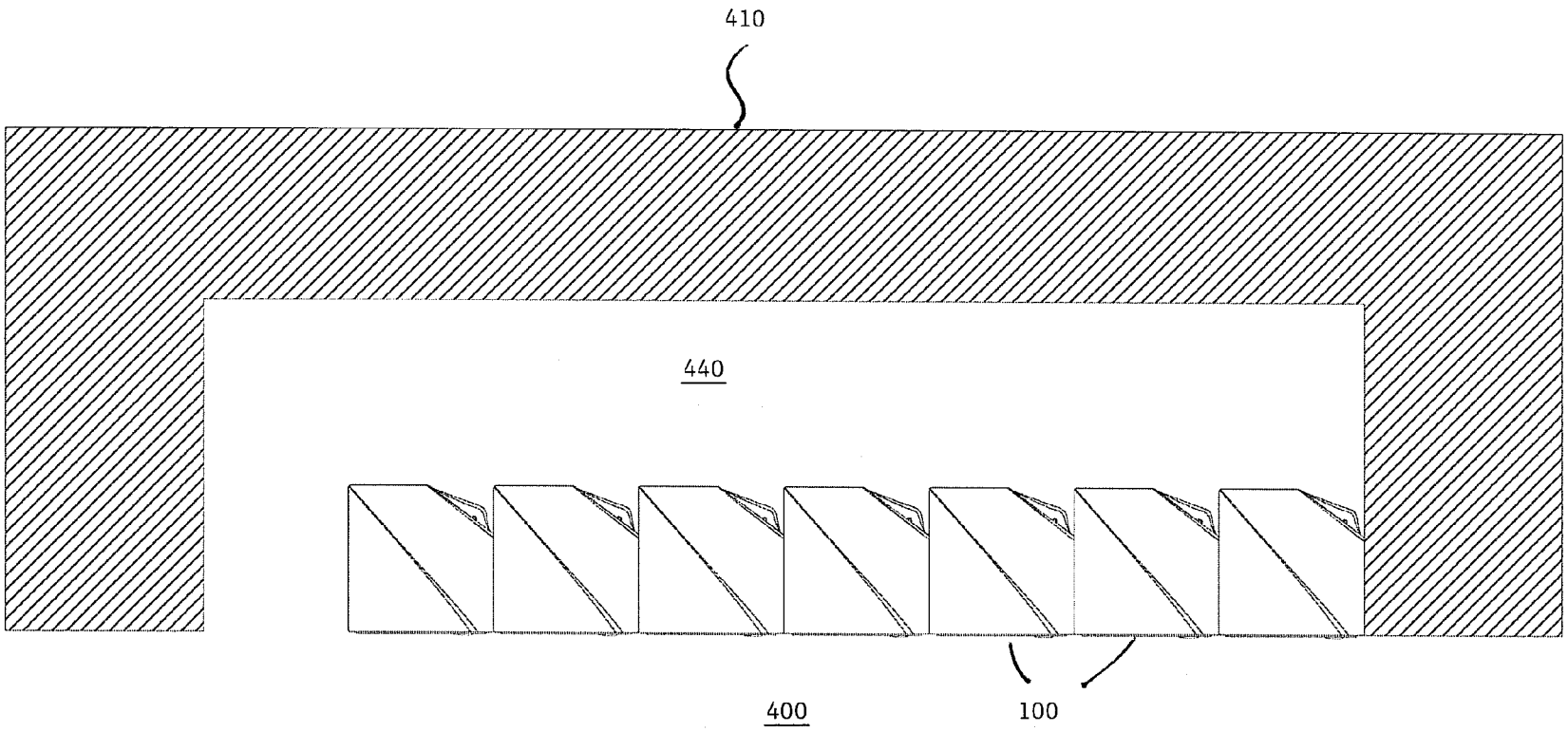
FIGS. 8A and 8B are the representative top and upper isometric views, respectively, of multiple multi-user portable toilets 100 of the present invention in a chamber arrangement 400.
Figure 8B:
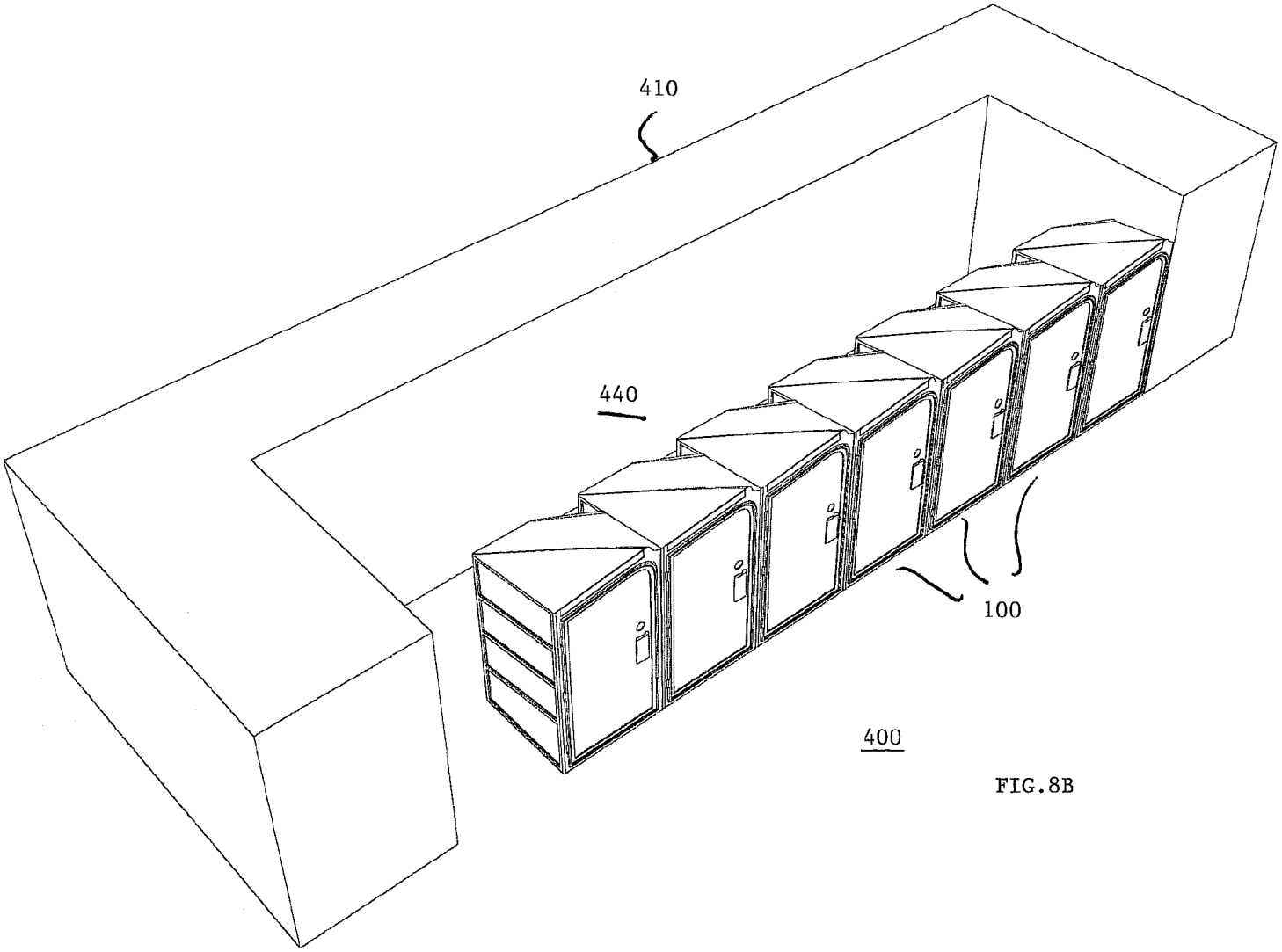

FIGS. 8A and 8B are representative top and upper isometric views, respectively, of multiple multi-user portable toilets 100 of the present invention in a chamber arrangement 400. Multiple multi-user portable toilets 100 can be installed, as best shown in FIG. 8A, to block on end of an event venue that has barricades 410 to create an instant outdoor lavatory 440 for urinal users.

Figure 9A:
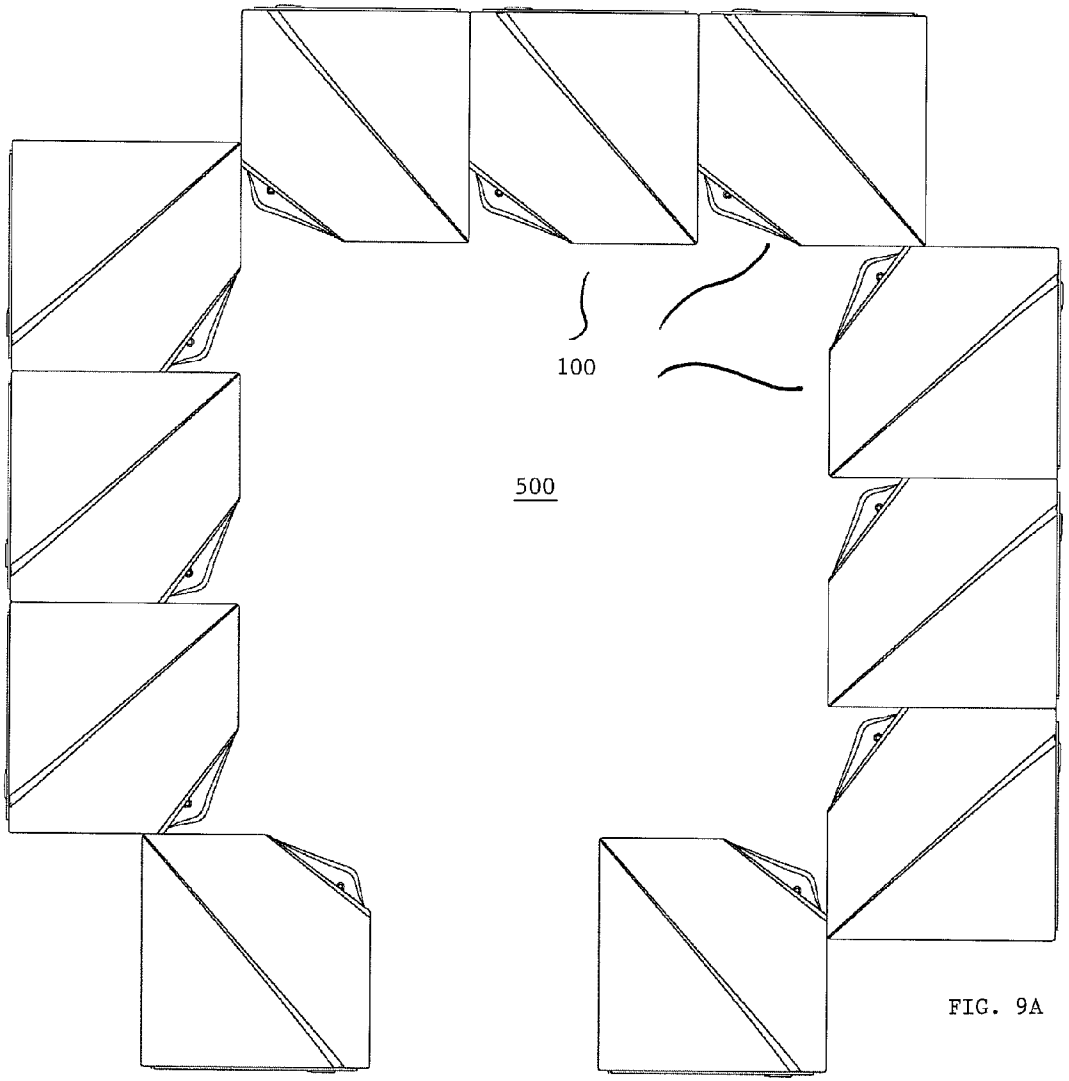
FIGS. 9A and 9B are the representative top and upper isometric views, respectively, of multiple multi-user portable toilets 100 of the present invention in a ring arrangement 500.
Figure 9B:
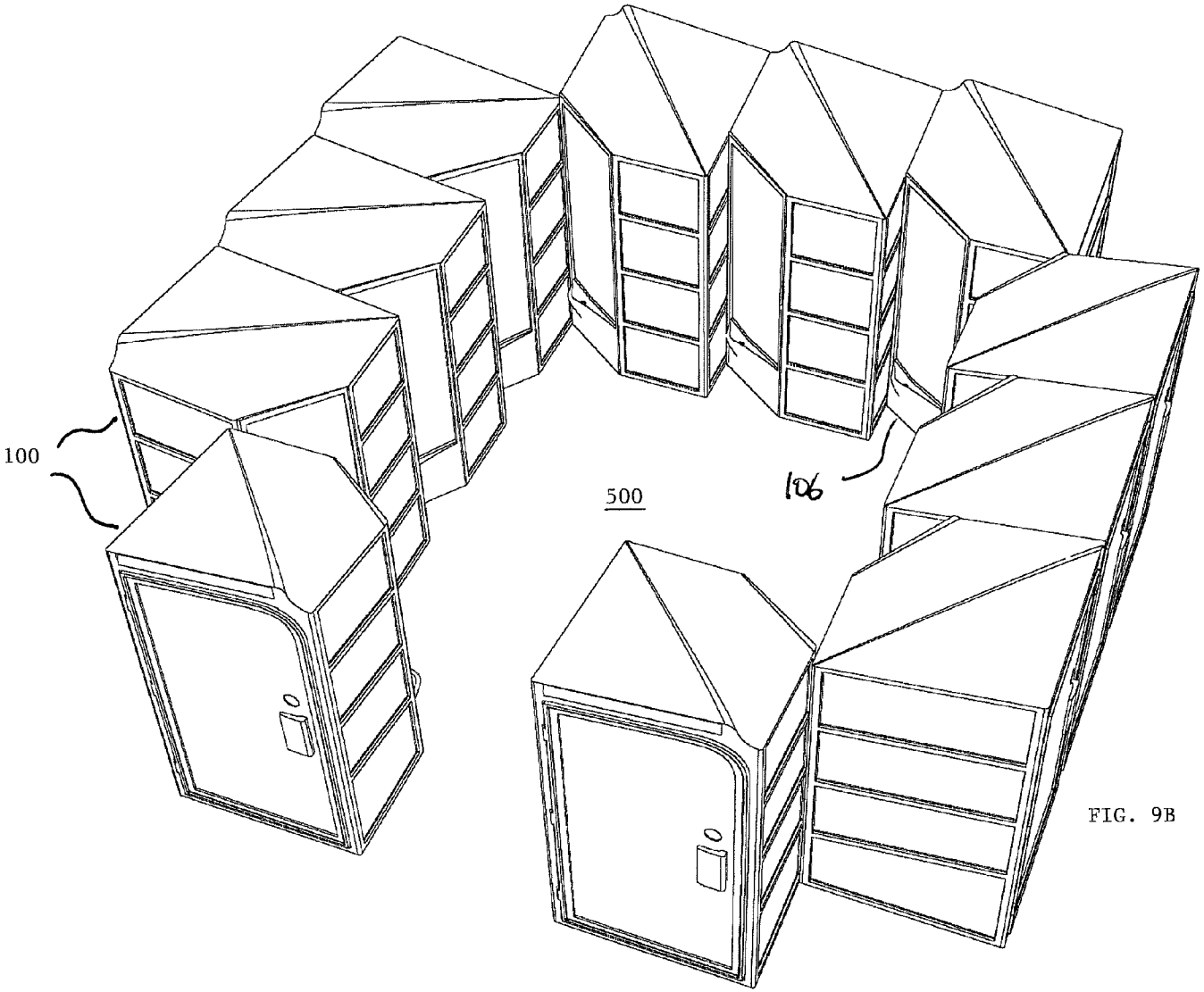

FIGS. 9A and 9B are representative top and upper isometric views, respectively, of multiple multi-user portable toilets 100 of the present invention in a ring arrangement 500. At event venues that no walls or barricades are available, multiple multi-user portable toilets 100 of the present invention can be installed in a ring arrangement 500. Instantaneously creating a larger area for users to use urinals 106.

For a better understanding of the invention reference is made to the following detailed description of the preferred embodiments thereof which should be taken in conjunction with the prior described drawings.

Unless defined otherwise, all technical and scientific terms used herein have the same meaning as commonly understood by one of ordinary skill in the art to which the present invention belongs. Although any methods and materials similar or equivalent to those described can be used in the practice or testing of the present invention, the preferred methods and materials are now described. All publications and patent documents referenced in the present invention are incorporated herein by reference.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, with the limits only of the true purview, spirit and scope of the invention.

I claim:

1. A temporary outdoor restroom area complex, the temporary outdoor restroom area complex comprising:

a row of 2 or more portable toilet units for simultaneous accommodation of one or more users, each of the plurality of portable toilet units having a pentagonal footprint and comprising:

(a) an outer shell portion formed by a front door panel having a right side and a left side, right and left side panels extending from the two sides of the front door panel, a back panel extending from the right side panels and a urinal panel extending between the back panel and the left side panel, the front door panel further having a door, the door having a mechanical closure, the outer shell portion having an essentially pentagonal horizontal cross section;

(b) a pentagonal top panel sealing the top of the outer shell portion, the top panel having a contoured profile, including a plurality of slants and edge railings to divert rain away from the front door panel and the urinal panel, the top panel further having one or more openings for ventilation;

(c) an internal compartment created by the outer shell portion and the top panel, the internal compartment further having a commode disposed therein, and a waste containment chamber disposed below the commode, the internal compartment further having an essentially pentagonal horizontal cross section;

(d) a floor portion separating the internal compartment from the ground;

(e) an external urinal unit disposed upon the urinal panel of the portable toilet unit outside of the internal compartment, the external urinal unit further connected to and emptying into the waste containment chamber via a drainage system; and (f) soundproofing to prevent sounds from passing through the outer shell portion, wherein the 2 or more portable toilet units are placed right next to each other in a straight row such that on one side there is a row of front doors all facing in the same direction, the left side panel at an angle to the side panel of the adjacent toilet unit, the units placed in a uniform row and between every two units there is a private urinal area.

* * * * *